US005437740A

United States Patent [19]

Bibber

[11] Patent Number: 5,437,740

[45] Date of Patent: Aug. 1, 1995

[54] CORROSION RESISTANT ALUMINUM AND ALUMINUM COATING

[75] Inventor: John W. Bibber, Batavia, Ill.

[73] Assignee: Sanchem, Inc., Chicago, Ill.

[21] Appl. No.: 322,238

[22] Filed: Oct. 13, 1994

Related U.S. Application Data

[63] Continuation-in-part of Ser. No. 50,841, Apr. 21, 1993, Pat. No. 5,358,623.

[51] Int. Cl.[6] ..... C23C 22/56

[52] U.S. Cl. ..... 148/273; 106/14.21

[58] Field of Search ..... 148/273; 106/14.21

[56] References Cited

U.S. PATENT DOCUMENTS 4,755,224 7/1988 Bibber ..... 106/14.21

4,988,396 1/1991 Bibber ..... 148/273

*Primary Examiner*—Sam Silverberg

*Attorney, Agent, or Firm*—Laff, Whitesel, Conte & Saret, Ltd.

[57] ABSTRACT

A non-chromium aluminum conversion coating composition for coating aluminum or an aluminum alloy which has as the essential ingredients an alkaline metal permanganate and aluminum nitrate and a pH of about 2.5 to about 4.0. The composition is effective in protecting aluminum and aluminum alloys for more than 168 hours in salt fog at 95° F. according to standard ASTM method B-117. The process, of coating the aluminum or aluminum alloy is generally carried out by cleaning the aluminum or aluminum alloy with sodium hydroxide, and nitric acid-hydrofluoric acid mixture, and then coating with the permanganate-nitrate composition. There is also provided an anodized aluminum or aluminum alloy coated with a non-chromium permanganate composition.

2 Claims, No Drawings

CORROSION RESISTANT ALUMINUM AND ALUMINUM COATING

This is a continuation in part of my patent application Ser. No. 08/050,841, filed Apr. 21, 1993 now U.S. Pat. No. 5,358,623.

The present invention relates to a method of treating anodized aluminum and aluminum alloys coated with a non-chromium corrosion resistant coating and to the articles produced thereby.

BACKGROUND OF THE INVENTION

Aluminum and aluminum alloys have been made corrosion resistant by providing a non-chromium conversion coating thereon as disclosed in our U.S. Pat. Nos. 4,755,224; 4,711,667; 4,895,608 and 4,988,396. These patents are generally related to aluminum conversion coatings and although they broadly cover aluminum coatings they do not specifically disclose protecting anodized aluminum and/or aluminum alloys nor do these patents specifically show protecting aluminum and aluminum alloys with a non-chromium composition of permanganate and nitrate with a pH of less than 7.

Aluminum metal and it's alloys are in many cases anodized or given an oxide film of controlled thickness in order to enhance corrosion resistance, and or paint adhesion. Additional corrosion resistance is necessary as the anodized oxide film is quite porous and thus allows the underlining metal to be exposed to corrosive agents.

Additional corrosion resistance is supplied by a process known as sealing. One of the earliest and still most widely used process, seals the surface by hydrating the oxide film in boiling water or steam. (Setah, S. and Mitays, A. *Proc. World Engineering Congress*, Tokay 1929) This causes it to swell and thus close off the surface to corrosive agents. Still other early methods involved converting the oxide film to aluminum silicate solution U.S. Pat. No. 1,746,153 and British Patent 393,996 (1931) with a hot silicate, filling the pores with cobalt or nickel hydroxide, (Speiser, C. T., *Electroplating and Metal Finishings*, 1956, 9, No. 4, 109–16, 128) and for maximum corrosion resistance U.S. Pat. No. 1,946,162, hydrating the oxide film in order to seal in a hexavalent chromate solution.

Also, the prior art prior to our above patents was mainly concerned with using hexavalent chromium compositions having a pH of less than 7.

SUMMARY OF THE INVENTION

Our invention eliminates some of the problems of hexavalent chromium and other heavy metal compositions by providing anodized aluminum and aluminum alloys with a non-chromium permanganate coating; providing a non-chromium aluminum and aluminum alloy conversion coating composition containing alkali metal permanganate and aluminum nitrate, as the essential ingredients; a method of protecting aluminum and aluminum alloys with a non-chromium conversion coating containing alkali metal permanganate and aluminum nitrate; and an aluminum and aluminum alloys having thereon a non-chromium conversion coating of permanganate and nitrate.

Therefore, it is an object of the present invention to provide a protective coated anodized aluminum or aluminum alloy comprising an anodized aluminum or aluminum alloy coated with a non-chromium mixed metal oxide coating of manganese and aluminum oxides.

It is another object of the present invention to provide a non-chromium aluminum conversion coating composition for providing aluminum and aluminum alloys with a protective coating wherein the composition has as essential ingredients alkali metal permanganate and aluminum nitrate.

It is another object of the present invention to provide a non-chromium corrosion resistant coated aluminum or aluminum alloy wherein the aluminum or aluminum alloy is coated with a non-chromium conversion coating composition of alkali metal permanganate and aluminum nitrate.

It is still a further object of the present invention to provide a method of protecting aluminum or aluminum alloys with a non-chromium conversion coating wherein the non-chromium coated aluminum or aluminum alloy is coated with a non-chromium coating composition of alkali metal permanganate and aluminum nitrate.

Other objects and advantages of the invention will become apparent by the following description of the invention.

We treat the anodized aluminum and/or aluminum alloy with a non-chromium alkali metal permanganate aqueous solution having a pH of from about 4 to about 8. The Alkali metal is selected from potassium, sodium or lithium. The preferred alkali metal permanganate is sodium or potassium permanganate.

The alkali metal permanganate compositions may be applied in any acceptable manner (i.e., immersion, spraying, misting or spreading by an appropriate applicator). The anodized aluminum or aluminum alloy surface is normally immersed in my aqueous alkali metal permanganate solution having a concentration of about 0.15 to about 0.60% by weight alkali metal permanganate with a preferred concentration of about 0.3% by weight. The temperature of the solution during the treatment of the oxidized or anodized aluminum is between 170° F. to about 212° F. or the boiling point of the solution.

The relatively high temperature is used to allow the permanganate to penetrate the oxide film. Also, the temperature appears to cause some swelling of the oxide film and permits the production of a mixed metal oxide film of manganese and aluminum oxide on the surface of the aluminum or aluminum alloy.

The upper concentration of the permanganate can be higher than the above indicated limit of 0.6%, but anything over this amount is not economically practical. The saturation limit of the permanganate is the upper limit of the concentration.

For non-anodized aluminum or aluminum alloy, especially cast aluminum and aluminum alloy, I utilize an acid composition of permanganate ions and nitrate ions. The preferred permanganate is the alkali metal permanganate as stated above and the nitrate is aluminum nitrate.

The composition is effective in protecting aluminum and aluminum alloys for more than 168 hours in salt fog at 95° F. according to standard ASTM method B-117. The process, of coating the aluminum or aluminum alloy is generally carried out by cleaning the aluminum or aluminum alloy with sodium hydroxide, and nitric acid-hydrofluoric acid mixture, and then coating with the permanganate-nitrate composition.

The preferred permanganate concentration is about 1.5 grams per liter to about 2.3 grams per liter with the minimum concentration recommended to provide 168 hours of protection being 760 ppm permanganate. The preferred temperature range is about 60° F. to 175° F. As the temperature is raised, less immersion time is necessary to form the corrosion resistant coating on the aluminum or aluminum alloy surface. The most preferred temperature is from about 100° F. to about 175° F. The preferred pH range is about 2.5 to about 4.0 with the most preferred pH being about 3.5 to about 4.0. The aluminum nitrate used is $Al(NO_3)_3.9H_2O$. The aluminum nitrate nine hydrate concentration is about 0.10% to about 10.0% with the preferred range being about 0.5% to about 2.0% $Al(NO_3)_3.9H_2O$.

The permanganate-nitrate composition is particularly advantageous when a relatively clear intermediate non-chromium protective coating is desired. A clear coating is obtained when the cast aluminum or aluminum alloy is coated for 20 seconds with the permanganate-nitrate composition.

The cast aluminum is coated with my permanganate-nitrate aqueous composition as noted above. The preferred method is by immersing the cast aluminum or aluminum alloy in the aqueous solution for about 20 seconds to about 2 minutes to form the non-chromium conversion coating.

Other non-chromium compounds may be added to the permanganate solutions if desired, providing the compounds do not interfere with the desired corrosion resistant protection of the anodized or non-anodized aluminum or aluminum alloy surfaces.

The cleaning compounds for the aluminum or aluminum alloy surfaces are trichloroethane, sodium hydroxide, potassium hydroxide, alkaline solutions of sodium nitrate, hydrofluoric acid, sulfuric acid, nitric acid, sodium carbonate, sodium bromate, borax, and a commercial non-ionic surfactant polyoxyethylene or polyoxypropylene derivatives of organic acids, alcohols, alkylphenols or amines.

After cleaning the aluminum or aluminum alloy surfaces, the cleaned aluminum or aluminum alloy is coated with the permanganate-nitrate composition or anodized and then coated with the permanganate composition.

It is also recommended that neither the cleaning composition nor the corrosion resistant alkali metal permanganate composition contain a fatty acid, or any compound which would interfere with adhesion or formation of a protective coating on the anodized or non-anodized aluminum or aluminum alloy surface.

The following examples illustrate specific embodiments of my invention and are not intended to limit the scope of my invention to the specific embodiments shown.

In the following examples, all percentages are percentages by weight unless otherwise indicated.

Examples 1–9 are directed to anodized aluminum and aluminum alloys and Examples 10 to 18 are directed to protecting aluminum alloys especially cast aluminum alloys with permanganate and nitrate ions. The cast aluminum utilized for Examples 10 to 18 was an aluminum alloy casting purchased from Metal Samples, Munford, Ala. 36268 and made from aluminum alloy 356.1 which has more than 90% by weight aluminum and has an average composition by weight of 6.5–7.5% Si, 0.25–0.40% Mg and a maximum percentage of 0.5% Fe, 0.25% Cu, 0.35% Mn, 0.35% Zn, 0.25% Ti and 0.15% other elements as impurities.

The following Examples 2–4 show that when our preferred limitations are not used, the panels have more pits than are generally desired.

EXAMPLE 1

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The anodized or oxidized aluminum sheet was rinsed in cold (70° F.–80° F.) de-ionized water for two minutes and further rinsed in warm (120° F.–130° F.) de-ionized water for five minutes. The anodized aluminum panel was then immersed in a 0.15% potassium permanganate aqueous solution at 190° F.–200° F. for 12 minutes followed by warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95° F. for 336 hours of exposure according to ASTM method B-117. The panel showed no noticeable pitting.

EXAMPLE 2

A sheet of pure aluminum (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) deionized water for two minutes and further rinsed in warm (120° F.–130° F.) de-ionized water for five minutes. The rinsed anodized sheet of aluminum was then immersed in a 0.10% potassium permanganate aqueous solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed more than 15 pits.

EXAMPLE 3

A sheet of pure aluminum (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes.

The voltage was maintained at 15 volts and the current density at about 15 amps per square foot.

The anodized or oxidized aluminum sheet was rinsed in cold (70° F.–80° F.) de-ionized water for two minutes and further rinsed in warm (120° F.–130° F.) de-ionized water for five minutes. The aluminum was then immersed in a 0.70% potassium permanganate aqueous solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95° F. for 336 hours of exposure according to ASTM method B-117. The panel showed more than 15 pits.

EXAMPLE 4

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) de-ionized water for two minutes and further rinsed in warm (120° F.–130° F.) de-ionized water for five minutes. The anodized aluminum surface was then reacted with or "sealed" in a 0.15 potassium permanganate aqueous solution at 160° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed more than 15 pits.

EXAMPLE 5

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The metal was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) de-ionized water for two minutes and further rinsed in warm (120° F.–130° F.) de-ionized water for five minutes. The anodized aluminum surface was then immersed in a 0.15% potassium permanganate aqueous solution at 170° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no noticeable pits.

EXAMPLE 6

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) de-ionized water for two minutes and further rinsed in warm (120° F.–130° F.) de-ionized water for five minutes. The anodized aluminum surface was then immersed in a 0.15% potassium permanganate aqueous solution at 212° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no noticeable pits.

EXAMPLE 7

A sheet of "2024-T3 aluminum alloy (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum alloy was then anodized in a solution of 5% sulfuric acid and 1.0% boric acid at 80° F. for 20 minutes. The voltage was maintained at 15 volts and the current density at about 15 amps per square foot.

The oxidized aluminum alloy sheet was rinsed in cold (70° F.–80° F.) de-ionized water for two minutes and further rinsed in warm (120° F.–130° F.) de-ionized water for five minutes. The anodized aluminum alloy surface was then immersed in a 0.3% potassium permanganate aqueous solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no pits.

EXAMPLE 8

A sheet of "2024-T3 aluminum alloy (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum alloy sheet was rinsed in cold (70° F.–80° F.) de-ionized water for two minutes and further rinsed in warm (120° F.–130° F.) de-ionized water for five minutes. The anodized aluminum alloy surface was then immersed in a 0.5% potassium permanganate aqueous solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no pits.

EXAMPLE 9

A sheet of "2024-T3 aluminum alloy (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum alloy was then anodized in a solution of 5% sulfuric acid and 1.0% boric acid at 80° F. for 20 minutes. The voltage was maintained at 15 volts and the current density at about 15 amps per square foot.

The oxidized aluminum alloy sheet was rinsed in cold (70° F.–80° F.) de-ionized water for two minutes and further rinsed in warm (120° F.–130° F.) de-ionized water for five minutes. The anodized aluminum alloy surface was then immersed in a 0.6% potassium permanganate aqueous solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B- 117. The panel showed no pits.

EXAMPLE 10

An aluminum alloy casting was degreased with mineral spirits and cleaned and etched in 5% sodium hydroxide solution for one minute at room temperature. The casting was then rinsed in deionized water, acid cleaned in a 70% nitric acid, 2.4% hydrofluoric acid, and 27.6% water mixture, and rinsed again in deionized water. The casting, which was at room temperature, was then placed in an aqueous solution having a temperature of 140° F. The solution is:

0.10% potassium permanganate—$KMnO_4$
0.10% aluminum nitrate nine hydrate—$Al(NO_3)_3.9H_2O$
99.8% water.

The casting remained in the solution for about 1 minute. The casting was removed from the solution, rinsed and dried and placed in a salt spray at 95 F for 168 hours according to ASTM Standard Method B-117. The casting showed no noticeable pitting in the treated area.

EXAMPLE 11

An aluminum alloy casting was degreased with mineral spirits and cleaned and etched in 5% sodium hydroxide solution for one minute at room temperature. The casting was then rinsed in deionized water, acid cleaned in a 70% nitric acid, 2.4% hydrofluoric acid, and 27.6% water mixture, and rinsed again in deionized water. The room temperature casting was then placed in an aqueous solution having a temperature of 140° F. for about 1 minute. The solution is:

0.2% potassium permanganate
0.10 % $Al(NO_3)_3.9H_2O$
99.7% water.

The casting was removed from the solution, rinsed and dried and placed in a salt spray at 95° F. for 168 hours according to ASTM Standard Method B-117. The casting showed no noticeable pitting in the treated area.

EXAMPLE 12

An aluminum alloy casting was degreased with mineral spirits and cleaned and etched in 5% sodium hydroxide solution for one minute at room temperature. The casting was then rinsed in deionized water, acid cleaner in a 70% nitric acid, 2.4% hydrofluoric acid, and 27.6% water mixture, and rinsed again in deionized water. The room temperature casting was then placed in an aqueous solution having a temperature of 140° F. for about 1 minute. The solution is:

0.5% potassium permanganate
0.10% aluminum nitrate nine hydrate
99.4% water.

The casting was removed from the solution, rinsed and dried and placed in a salt spray at 95° F. for 168 hours according to ASTM Standard Method B-117. The casting showed no noticeable pitting in the treated area.

EXAMPLE 13

An aluminum alloy casting was degreased with mineral spirits and cleaned and etched in 5% sodium hydroxide solution for one minute at room temperature. The casting was then rinsed in deionized water, acid cleaner in a 70% nitric acid, 2.4% hydrofluoric acid, and 27.6% water mixture, and rinsed again in deionized water. The room temperature casting was then placed in an aqueous solution having a temperature of 140° F. for about 1 minute. The solution is:

1.0% Potassium Permanganate
0.10% Aluminum Nitrate Nine Hydrate
99.9% water.

The casting was removed from the solution, rinsed and dried and placed in a salt spray at 95° F. for 168 hours according to ASTM Standard Method B-117. The casting showed no noticeable pitting in the treated area.

EXAMPLE 14

An aluminum alloy casting was degreased with mineral spirits and cleaned and etched in 5% sodium hydroxide solution for one minute at room temperature. The casting was then rinsed in deionized water, acid cleaned in a 70% nitric acid, 2.4% hydrofluoric acid, and 27.6% water mixture, and rinsed again in deionized water. The room temperature casting was then placed in an aqueous solution having a temperature of 140° F. for about 1 minute. The solution is:

0.3% Potassium Permanganate
0.5% Aluminum Nitrate Nine Hydrate
99.2% water

The casting was removed from the solution, rinsed and dried and placed in a salt spray at 95° F. for 168 hours according to ASTM Standard Method B-117. The casting showed no noticeable pitting in the treated area.

EXAMPLE 15

An aluminum alloy casting was degreased with mineral spirits and cleaned and etched in 5% sodium hydroxide solution for one minute at room temperature. The casting was then rinsed in deionized water, acid cleaner in a 70% nitric acid, 2.4% hydrofluoric acid, and 27.6% water mixture, and rinsed again in deionized water. The room temperature casting was then placed in an aqueous solution having a temperature of 140° F. for about 1 minute. The solution is:

0.3% Potassium Permanganate
1.0% Aluminum Nitrate Nine Hydrate
98.7% water.

The casting was removed from the solution, rinsed and dried and placed in a salt spray at 95° F. for 168 hours according to ASTM Standard Method B-117. The casting showed no noticeable pitting in the treated area.

EXAMPLE 16

An aluminum alloy casting was degreased with mineral spirits and cleaned and etched in 5% sodium hydroxide solution for one minute at room temperature. The casting was then rinsed in deionized water, acid cleaned in a 70% nitric acid, 2.4% hydrofluoric acid, and 27.6% water mixture, and rinsed again in deionized water. The room temperature casting was then placed in an aqueous solution having a temperature of 140° F. for about 1 minute. The solution is:

0.3% Lithium Permanganate
2.0% Aluminum Nitrate Nine Hydrate
98.7% water.

The casting was removed from the solution, rinsed and dried and placed in a salt spray at 95° F. for 168 hours according to ASTM Standard Method B-117. The casting showed no noticeable pitting in the treated area.

EXAMPLE 17

An aluminum alloy casting was degreased with mineral spirits and cleaned and etched in 5% sodium hydroxide solution for one minute at room temperature. The casting was then rinsed in deionized water, acid cleaned in a 70% nitric acid, 2.4% hydrofluoric acid, and 27.6% water mixture and rinsed again in deionized water. The room temperature casting was then placed in an aqueous solution having a temperature of 140° F. for about 1 minute. The solution is:

0.3% Potassium Permanganate
1.0% Aluminum Nitrate Nine Hydrate
98.7% water

The casting was removed from the solution, rinsed and dried and placed in a salt spray at 95° F. for 168 hours according to ASTM Standard Method B-117. The casting showed no noticeable pitting in the treated area.

EXAMPLE 18

An aluminum alloy casting was degreased with mineral spirits and cleaned and etched in 5% sodium hydroxide solution for one minute at room temperature. The casting was then rinsed in deionized water, acid cleaned in a 70% nitric acid, 2.4% hydrofluoric acid, and 27.6% water mixture, and rinsed again in deionized water. The room temperature casting was then placed in an aqueous solution having a temperature of 140° F. for about 1 minute. The solution is:

03% Potassium Permanganate
1.0% Aluminum Nitrate Nine Hydrate
98.7% water

The casting was removed from the solution, rinsed and dried and placed in a salt spray at 95° F. for 168 hours according to ASTM Standard Method B-117. The casting showed no noticeable pitting in the treated area.

I claim:

1. A method of protecting non-anodized aluminum or aluminum alloy with a non-chromium coating comprising contacting the aluminum or aluminum alloy with an aqueous solution containing as the essential ingredients thereof an alkali metal permanganate and an aluminum nitrate, said aqueous coating solution contains at least 760 ppm of permanganate and about 0.10 to 10.0% of aluminum nitrate, maintaining the pH of the solution at about 2.5 to about 4.0, maintaining the temperature of the solution at about 140° to 170° F., immersing the aluminum or aluminum alloy in the solution for at least 20 seconds to form a protective conversion coating on the aluminum or aluminum alloy and removing any excess coating solution from the aluminum or aluminum alloy.

2. The method of claim 1 wherein the aqueous coating solution contains at least about 1.5 gms of sodium permanganate per liter of solution and about 0.5% to about 2.0% by weight of $Al(NO_3)_3.9H_2O$.

* * * * *